US005129709A

United States Patent [19]

Klamer

[11] Patent Number: 5,129,709

[45] Date of Patent: Jul. 14, 1992

[54] WHEEL FOR ROLLER SKATE AND THE LIKE

[76] Inventor: Reuben Klamer, 828 Prospect St., La Jolla, Calif. 92037

[21] Appl. No.: 694,875

[22] Filed: May 2, 1991

[51] Int. Cl.[5] ..... A63C 17/22; B60B 5/02

[52] U.S. Cl. ..... 301/5.3; 301/63 PW

[58] Field of Search ..... 301/5.7, 5.3, 63 PW; 152/210, 212

[56] References Cited

U.S. PATENT DOCUMENTS

| | | | |
|---|---|---|---|
| 1,687,113 | 10/1928 | Stockdale | 301/5.3 X |
| 2,878,071 | 3/1959 | Rowlkes | 301/5.3 |
| 4,208,073 | 6/1980 | Hechinger | 301/5.3 |
| 4,217,944 | 8/1980 | Pascal | 301/63 PWX |
| 4,666,169 | 5/1987 | Hamill et al. | 301/63 PWX |
| 4,699,432 | 10/1987 | Klamer | 301/5.3 |

FOREIGN PATENT DOCUMENTS

| | | | |
|---|---|---|---|
| 1275900 | 8/1968 | Fed. Rep. of Germany | 301/63 PW |

*Primary Examiner*—Russell D. Stormer

*Attorney, Agent, or Firm*—Herbert Dubno; Andrew Wilford

[57] ABSTRACT

A wheel adapted to be rotated about a normally horizontal axis perpendicular to a normal direction of travel has a hub centered on the axis and a central core body made of a hard material and coaxially surrounding the hub. This core body has an annular outer surface centered on and turned radially away from the axis and having a pair of axially opposite edges. A pair of similar side-wall bodies of a soft material symmetrically flank and are joined to the core body and each have an annular surface having a radial outer edge joining the core body at a respective one of the edges thereof and a radial inner edge at the hub. The surfaces of the side-wall bodies curve continuously from their outer edges to their inner edges.

5 Claims, 1 Drawing Sheet

WHEEL FOR ROLLER SKATE AND THE LIKE

FIELD OF THE INVENTION

The present invention relates to a wheel for a recreational vehicle or toy. More particularly this invention concerns a wheel usable on an in-line or quad roller skates or even on a bicycle or the like.

BACKGROUND OF THE INVENTION

In my earlier U.S. Pat. No. 4,699,432 I describe a wheel usable on a standard quad, that is four-wheel, roller skate whose running surface is formed by two different materials. A hard resin forms a cylindrical base that is provided with a plurality of set-in plugs of a substantially softer resin, or a strip of harder material is provided that runs along the center of the ground-engaging surface. The softer resin provides improved traction.

Such an arrangement does provide improved performance on a quad roller skate as regards side-to-side traction but does exact some loss in performance as regards straight-ahead travel in that the soft material slows the wheel down. If such a wheel is used on an in-line roller skate or on a bicycle wheel, when the wheel is turned during stopping or turning to engage the ground with its side wall, the added traction of this system is completely lost. Under these circumstances only the hard material of the wheel engages the ground so there is no added traction.

OBJECTS OF THE INVENTION

It is therefore an object of the present invention to provide an improved wheel for use on a roller skate, bicycle, or the like.

Another object is the provision of such an improved wheel for use on a roller skate, bicycle, or the like which overcomes the above-given disadvantages, that is which provides good performance for straight-ahead travel and good traction for turning and stopping.

Another object is to provide an improved roller skate equipped with a wheel according to the present invention.

SUMMARY OF THE INVENTION

A wheel adapted to be rotated about a normally horizontal axis perpendicular to a normal direction of travel has a hub centered on the axis and a central core body made of a hard material and coaxially surrounding the hub. This core body has an annular radially outwardly directed outer surface centered on the axis and having a pair of axially opposite edges. A pair of similar side-wall bodies of a soft material symmetrically flank and are joined to the core body and each have an annular surface having a radial outer edge joining the core body at the respective edge and a radial inner edge at the hub. The surfaces of the side-wall bodies curve continuously from their outer edges to their inner edges. The soft and hard materials are both normally synthetic resins.

Thus when moving straight ahead the wheel will be riding virtually only on the hard outer surface of the core body. Resistance to rolling will therefore be minimal for maximum speed. On curves the side-wall surfaces, however, will contact the ground. Since the side bodies are softer this will mean increased traction and less likelihood of slipping. As a result the wheel according to the present invention gives the high-speed performance in the straightaway of a one-piece hard wheel and the good grip and cornering ability of a much softer one.

According to this invention the annular surfaces of the side bodies are oppositely outwardly convex. In addition the outer surface of the core body forms a smooth continuation of the outer surfaces of the side bodies.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
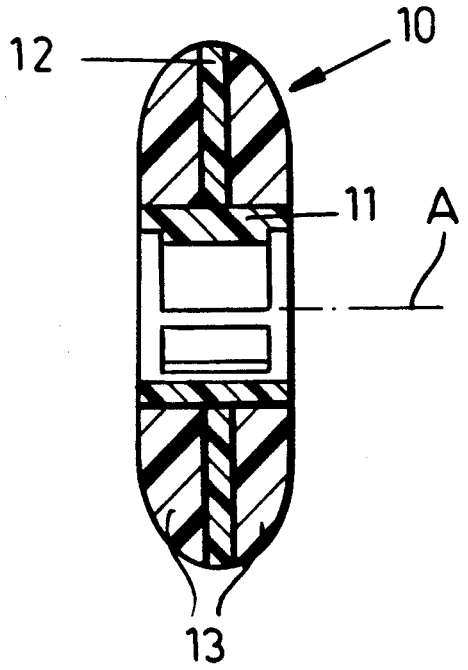
FIG. 1 is an axial section through the wheel according to this invention.

As seen in the drawing a wheel 10 according to this invention is centered on a normally horizontal axis A and basically comprises a hub 11, an annular core body or disk 12, and a pair of identical and also annular side bodies 13. The core disk is made of Vibrathane B-821 TM (Uniroyal) having a Shore A hardness of 82 to 88 and the side bodies are made of Rynite SST 35 TM (Dupont) having a Shore A hardness of 78.

According to this invention the center disk 10 has an outer edge surface which can be of outwardly convex shape a illustrated or even of cylindrical shape. The two side bodies 13 have outer surfaces which extend along oppositely outwardly convex curves, each such outer surface basically being a quadrant of an ellipse. The edges and faces of the bodies 11 and 13 are permanently bonded to each other so that separation is virtually impossible, and they are similarly bonded to the hub 11.

Figure 2:
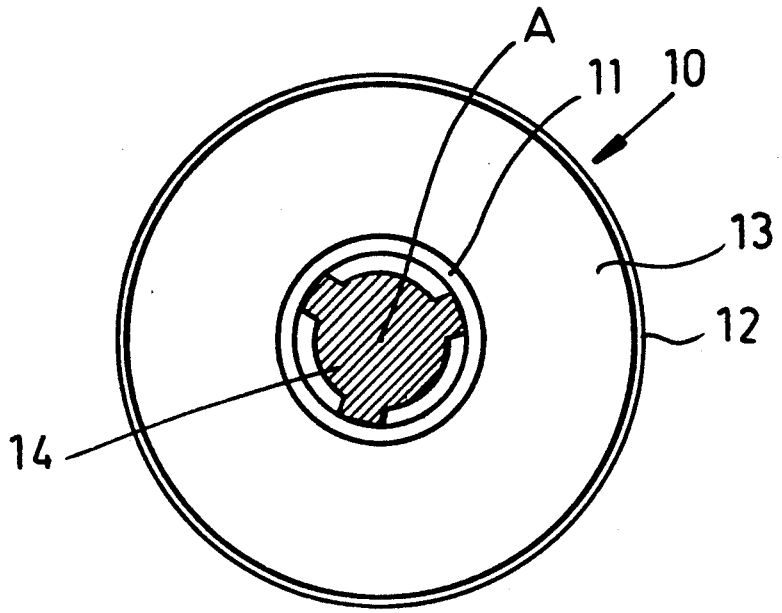
FIG. 2 is a side view of the wheel of this invention mounted on a roller-skate shaft shown in cross section.

This hub 11 is formed with inwardly directed lugs that assist in mounting it on a roller skate whose wheel axle is shown at 14 in FIG. 2.

The overall diameter perpendicular to the axis A of the wheel 10 is 2.75 in, the axial dimension at the hub 11 is 0.875 in, the inside diameter of the hub is also 0.875 in, and the axial thickness of the core body 12 is 0.125 in. Thus the axial thickness of the core body 12 is about one-seventh the overall axial dimension of the wheel 10.

I claim:

1. A wheel adapted to be rotated about a normally horizontal axis perpendicular to a normal direction of travel, the wheel comprising:

a hub centered on the axis;

a central core body made of a hard material and coaxially surrounding the hub, the core body having an annular outer surface centered on and turned radially away from the axis and having a pair of axially opposite edges; and a pair of similar side-wall bodies of a soft material symmetrically flanking and joined to the core body and each having an annular surface having a radial outer edge joining the core body at a respective one of the edges thereof and a radial inner edge at the hub, the outer surfaces of the side-wall bodies meeting the outer surface of the core body at the edges thereof and forming a smooth continuation of the outer surface of the core body.

2. The wheel defined in claim 1 wherein the annular surfaces of the side bodies are oppositely outwardly convex.

3. The wheel defined in claim 1 wherein the materials are both resins.

4. A wheel adapted to be rotated about a normally horizontal axis perpendicular to a normal direction of travel, the wheel comprising:

a hub centered on the axis;

a central core body made of a hard material and coaxially surrounding the hub, the core body having an annular outer surface centered on and turned radially away from the axis and having a pair of axially opposite edges; and a pair of similar side-wall bodies of a soft material symmetrically flanking and joined to the core body and each having an annular surface having a radial outer edge joining the core body at a respective one of the edges thereof and a radial inner edge at the hub, the surfaces of the side-wall bodies curving continuously from their outer edges to their inner edges, the outer surface of the core body forming a smooth continuation of the outer surfaces of the side bodies.

5. In combination with an in-line roller skate, a wheel adapted to be rotated about a normally horizontal axis perpendicular to a normal direction of travel, the wheel comprising:

a hub centered on the axis;

a central core body made of a hard material and coaxially surrounding the hub, the core body having an annular outer surface centered on and turned radially away from the axis and having a pair of axially opposite edges; and a pair of similar side-wall bodies of a soft material symmetrically flanking and joined to the core body and each having an annular surface having a radial outer edge joining the core body at a respective one of the edges thereof and a radial inner edge at the hub, the outer surfaces of the side-wall bodies meeting the outer surface of the core body at the edges thereof and forming a smooth continuation of the outer surface of the core body.

* * * * *